US011389022B2

(12) United States Patent
Lind et al.

(10) Patent No.: US 11,389,022 B2
(45) Date of Patent: Jul. 19, 2022

(54) BOOT JACK

(71) Applicants: Susan Bailey Lind, Murray, UT (US); Stephen Gregg Bailey, Albany, CA (US)

(72) Inventors: Susan Bailey Lind, Murray, UT (US); Stephen Gregg Bailey, Albany, CA (US)

( * ) Notice: Subject to any disclaimer, the term of this patent is extended or adjusted under 35 U.S.C. 154(b) by 169 days.

(21) Appl. No.: 16/703,962

(22) Filed: Dec. 5, 2019

(65) Prior Publication Data

US 2021/0169257 A1 Jun. 10, 2021

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/86
USPC ..... 223/114, 115, 116, 117; D2/642
See application file for complete search history.

(56) References Cited

U.S. PATENT DOCUMENTS

| | | | | | |
|---|---|---|---|---|---|
| D6,896 | S | * | 9/1873 | Fogelstrand | D2/642 |
| 254,816 | A | | 3/1882 | Greenwald | |
| 432,941 | A | * | 7/1890 | Heth | A47G 25/80 223/114 |
| D34,456 | S | * | 4/1901 | Consolla | D2/642 |
| 1,178,109 | A | * | 4/1916 | Stauby | A47G 25/80 223/114 |
| 2,883,097 | A | | 4/1959 | Scardamalia et al. | |
| D244,806 | S | | 6/1977 | Pryor | |
| 4,394,946 | A | * | 7/1983 | McCormick | A47G 25/80 223/115 |
| D274,673 | S | * | 7/1984 | McCormick | D2/642 |
| D347,313 | S | | 5/1994 | Whitaker | |
| 7,048,159 | B1 | * | 5/2006 | Bowers | A47G 25/80 223/115 |
| D628,866 | S | * | 12/2010 | Serret | D8/17 |
| D633,687 | S | | 3/2011 | Zeller et al. | |
| D646,046 | S | * | 10/2011 | Paine | D2/642 |

FOREIGN PATENT DOCUMENTS

| | | | | |
|---|---|---|---|---|
| DE | 202011004079 U1 | * | 6/2011 | A47G 25/86 |
| DE | 202011004079 U1 | | 6/2011 | |

OTHER PUBLICATIONS

"https://www.basspro.com/shop/en/redhead-boot-jack," Screenshot obtained Aug. 11, 2019.

* cited by examiner

*Primary Examiner* — F Griffin Hall
(74) *Attorney, Agent, or Firm* — Oliff PLC

(57) ABSTRACT

A boot jack includes a base, an intermediate portion extending from the base, and a boot grip portion extending from the intermediate portion. The boot jack has an overall tapered shape, which can allow the boot jack to fit into an empty boot for storage.

6 Claims, 6 Drawing Sheets

BOOT JACK

BACKGROUND

This disclosure relates a boot jack, used to assist a person wearing a boot to remove the boot.

Boot jacks have long been known that assist a person wearing a boot to more easily remove the boot. Typically, the person places one foot on a base of the boot jack, places the heel of the other foot, which is wearing the boot to be removed, in a boot grip portion of the boot jack, and retracts the other foot from the boot that is being held by the boot grip portion of the boot jack.

SUMMARY

A boot jack according to at least some embodiments according to this disclosure is particularly sized and shaped to be able to fit into an empty boot, thus being easily portable and taking up little or no extra space when stored.

BRIEF DESCRIPTION OF THE DRAWINGS

Embodiments will be described with reference to the attached drawings, in which like reference numerals represent like parts, and in which.

DETAILED DESCRIPTION OF EMBODIMENTS

Figure 1:
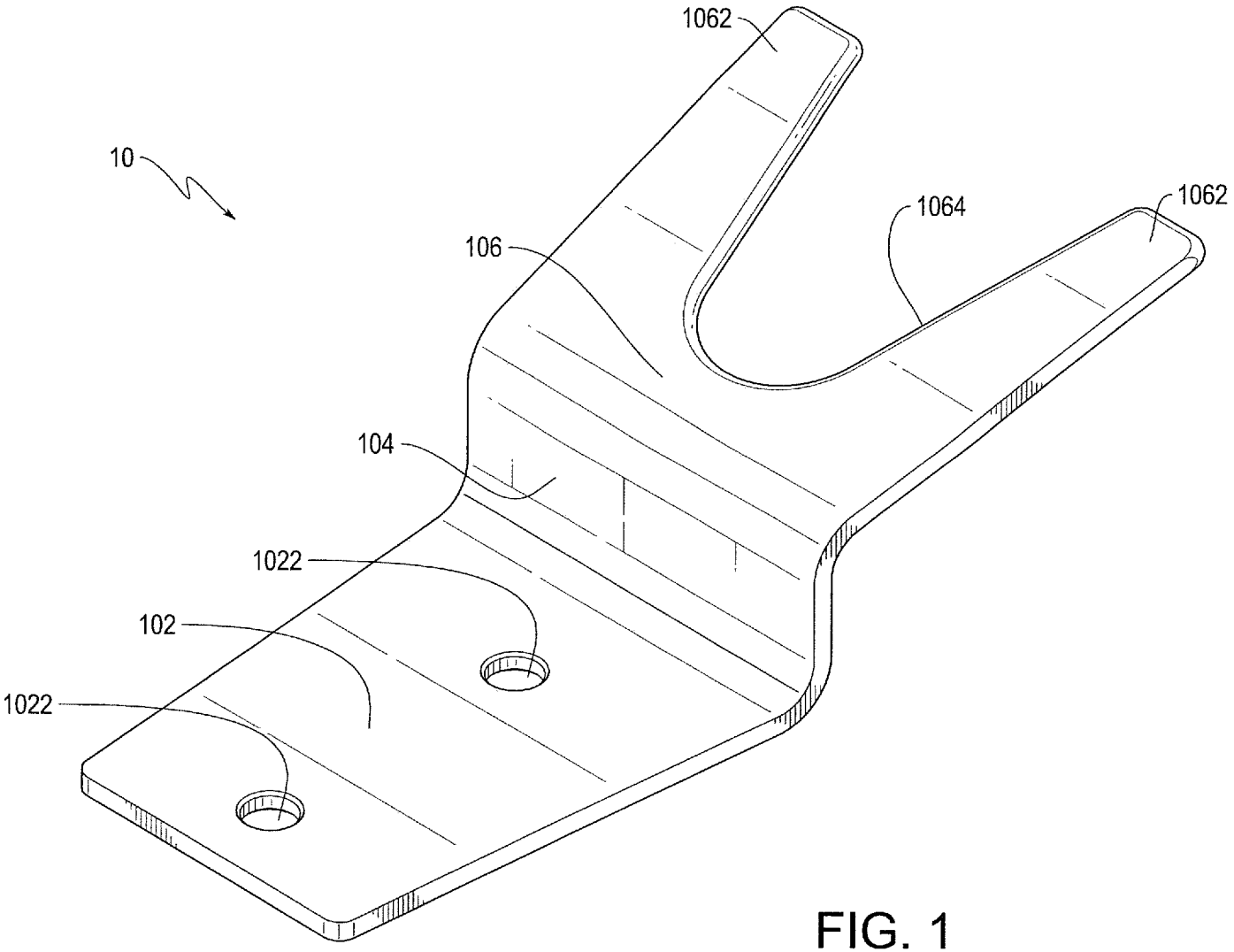
FIG. 1 is a perspective view of a boot jack.

FIG. 1 is a perspective view of a boot jack 10 according an embodiment. The boot jack 10 includes a base 102, an intermediate portion 104, and a boot grip portion 106. Holes 1022 may be provided in the base as shown. The holes 1022 may be used, for example, to hang the boot jack 10 on a hook or nail, or on a point-of-sale display board or the like.

Figure 2:
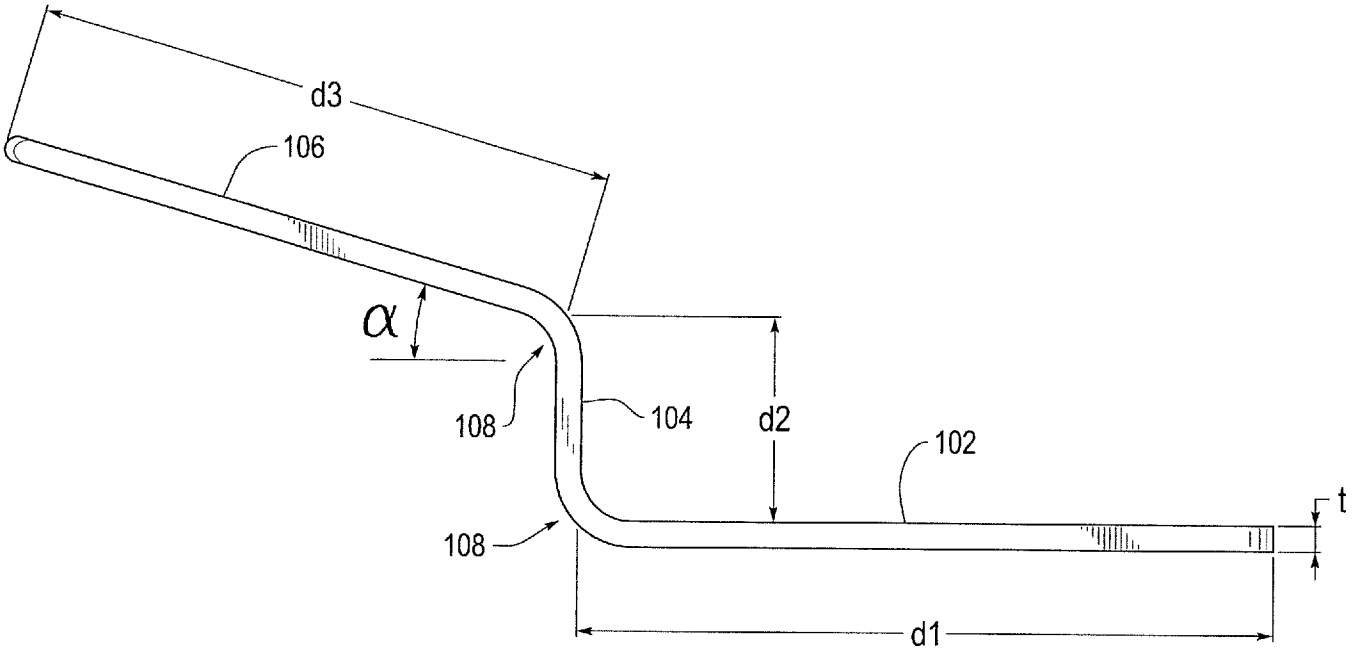
FIG. 2 is a left side view of the boot jack of FIG. 1, the right side being a mirror image of the left side.

The intermediate portion 104 may extend substantially perpendicularly relative to the base 102, as seen in the side view of FIG. 2, and the boot grip portion 106 may extend at an angle $\alpha$ relative to a line parallel to the base 102, as also seen in the side view. The angle $\alpha$ may be in a range of from 0° to 45°, such as any value from 0° to 45°. An angle $\alpha$ of 10°, 11°, 12°, 13, 14°, 15°, 16°, 17°, 18°, 19° or 20° is effective in at least one embodiment. Rounded transitions 108 may be provided between the base 10 and the intermediate portion 104, and between the intermediate portion 104 and the boot grip portion 106, as shown in the drawings. The rounded transitions 108 can help avoid stress concentrations that may promote fracturing of the boot jack. The rounded transitions 108 may have a radius in a range of from ⅛" to 1", such as any value from ⅛" to 1". A radius of the transitions 108 of from ¼" to ½", such as about 0.3" or 0.4", is effective in at least one embodiment.

The base 102 may have a length d1 in a range of from 3" to 9", such as any value from 3" to 9". A length d1 of about 5" or 6" is effective in at least one embodiment. The intermediate portion 104 may have a length d2 in a range of from ½" to 3", such as any value from ½" to 3". A length d2 of about 1.25", 1.5" or 1.75" is effective in at least one embodiment. The boot grip portion 106 may have a length d3 in a range of from 2" to 6", such as any value from 2" to 6". A length d3 of about 4.25", 4.4", 4.5", 4.6" or 4.75" is effective in at least one embodiment.

The base 102, intermediate portion 104 and the boot grip portion 106 may all have the same thickness t. This may provide an advantage in terms of manufacturing processes and/or costs, because the boot jack 10 can be formed from a single sheet of material of uniform thickness. However, in some embodiments, the base 102, intermediate portion 104 and the boot grip portion 106 may have different thicknesses. A thickness t of 3/16" has been shown to be effective when the material is aluminum. Depending on the material and/or other structural considerations, it is expected that a thickness tin a range of from 1/16" to ¾" will be acceptable.

The various portions of the boot jack 10 may be made of the same material, such as plastic, wood, aluminum or other metal, or a composite material. Alternatively, different portions of the boot jack 10 may be made of different materials, and joined together by known techniques. One such known technique is insert molding, in which, for example, one portion of the boot jack 10 may be made of metal with one or more tangs (not shown) protruding, and the one or more tangs may be positioned in a mold and then plastic material may be injected into the mold so as to surround the one or more tangs, resulting in the plastic and metal parts being joined together when the molten plastic hardens. In the case of a boot jack 10 made of wood, the boot jack 10 may be made from a thin sheet of wood that is steam bent into the final desired shape of the boot jack. Alternatively, the boot jack 10 may be machined directly into its final shape from a thick block of wood. When made from plastic or metal material, the boot jack 10 may, for example, be (i) cut out from a sheet of material, heated if necessary, and then bent into the final desired shape; (ii) cast into the final desired shape using a mold, or (iii) machined directly into its final shape from a thick block of material. It is expected that the method of cutting from a sheet of material, heating if necessary, and bending will provide material and/or cost savings over other methods.

Figure 3:
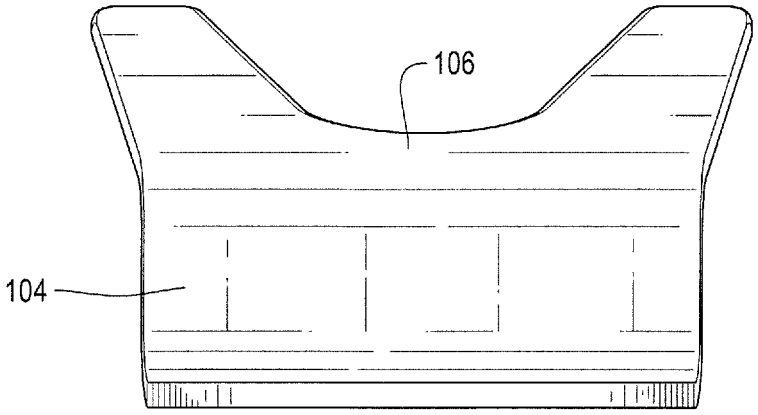
FIG. 3 is a rear view of the boot jack of FIG. 1.
Figure 4:
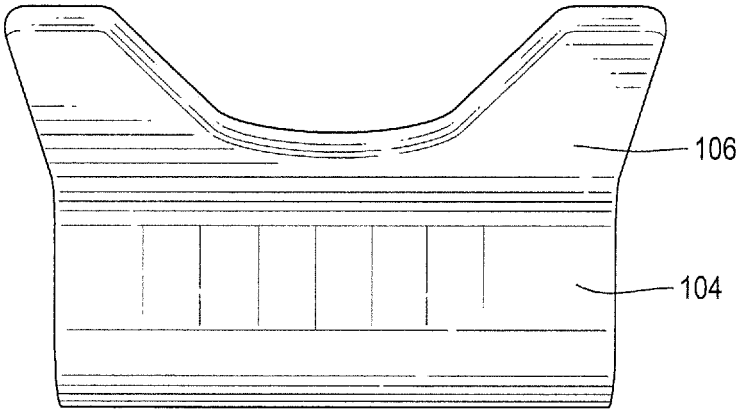
FIG. 4 is a front view of the boot jack of FIG. 1.
Figure 5:
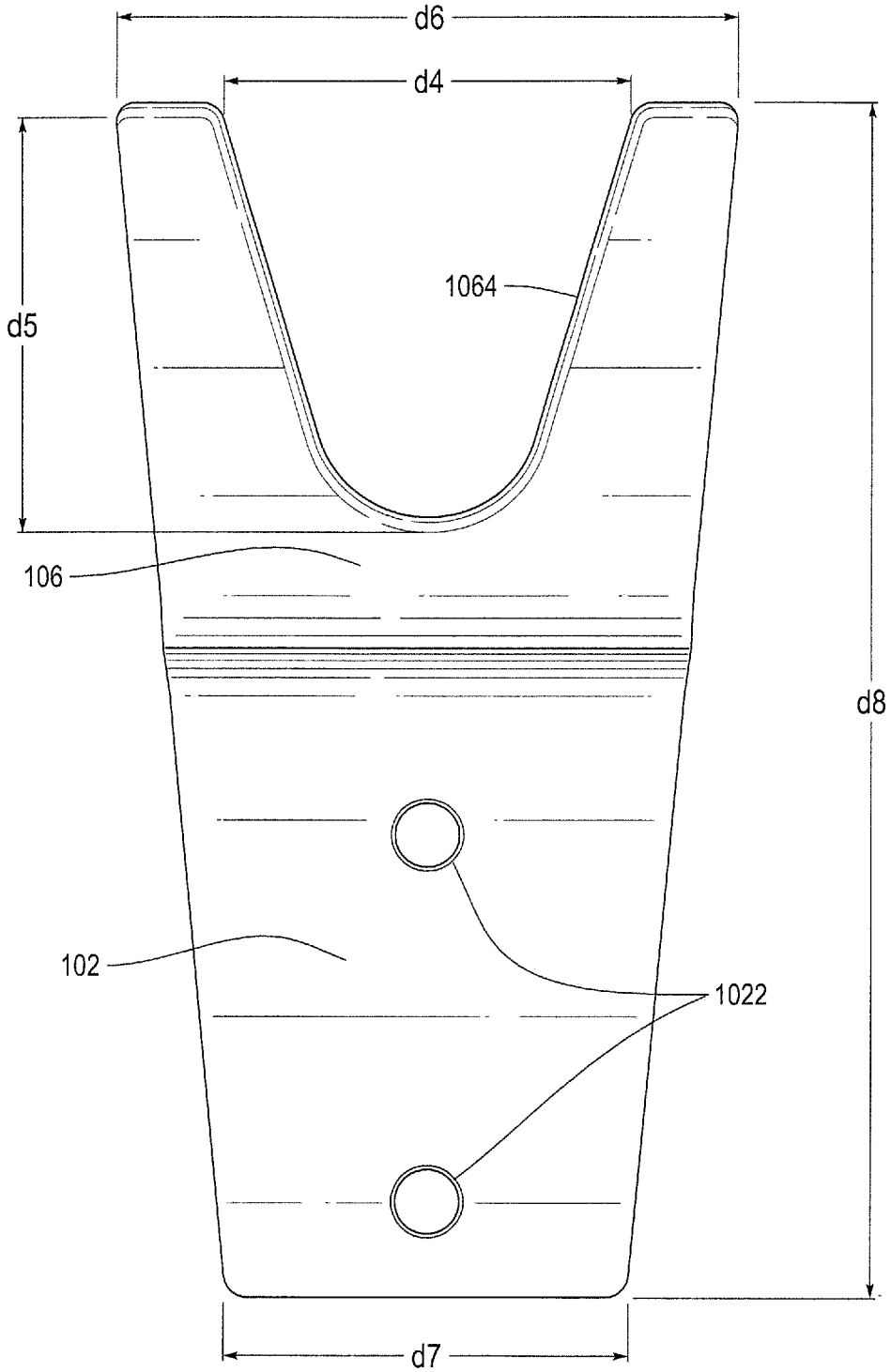
FIG. 5 is a top view of the boot jack of FIG. 1.
Figure 6:
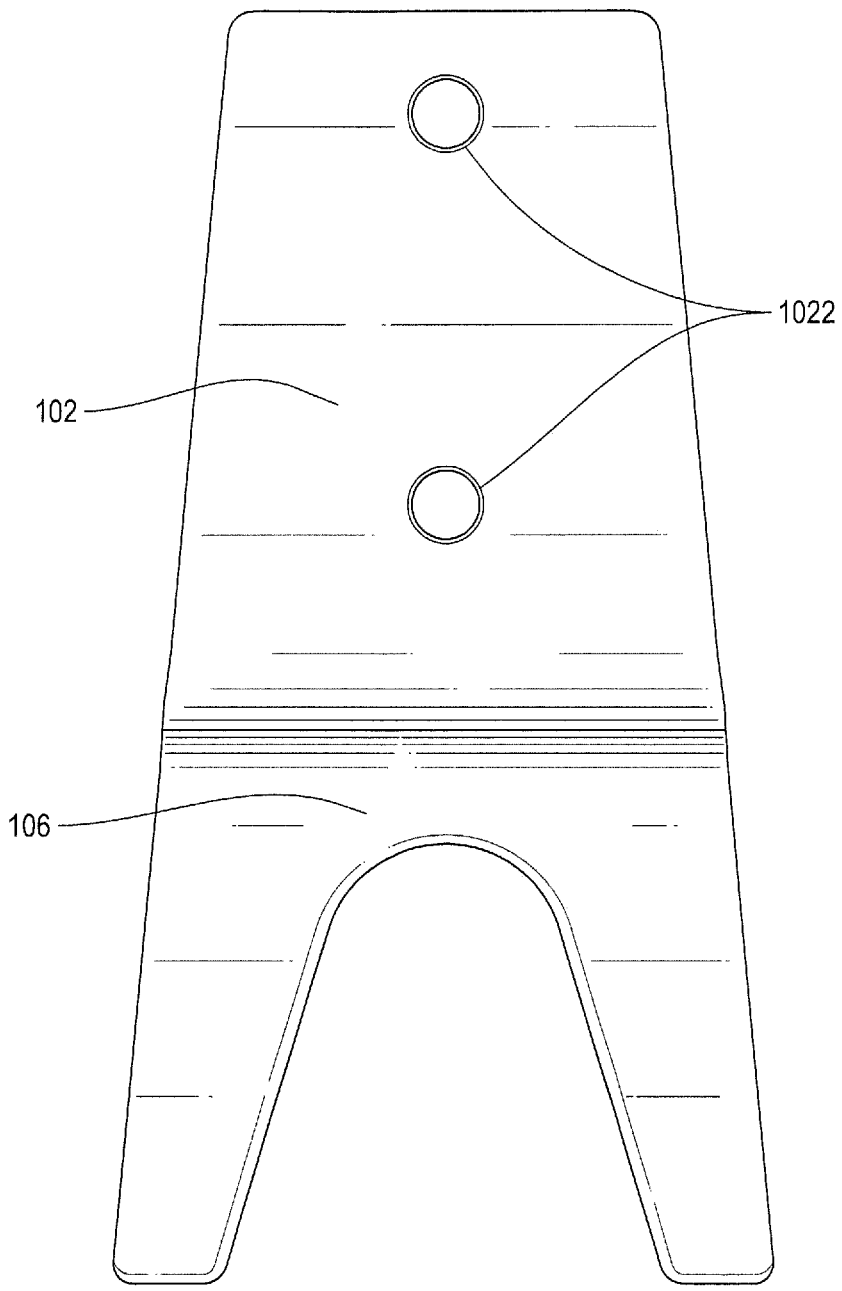
FIG. 6 is a bottom view of the boot jack of FIG. 1.

FIG. 3 is a rear view of the boot jack 10, and FIG. 4 is a front view of the boot jack of FIG. 1. FIG. 5 is a top view of the boot jack 10. As shown in FIG. 5, the boot grip portion 106 includes a boot grip contour 1064, defined between arm portions 1062, that is shaped to fit, at least approximately, the shape of a heel of a boot. The boot grip contour 1064 has a maximum width dimension d4 and maximum depth dimension d5. Although FIG. 5 is a plan view, the dimensions d4 and d5 extend in a direction parallel to the plane of the boot grip portion 106. That is, in FIG. 5, the dimension d5, for example, is viewed in parallax. The dimension d4 may be in a range of from 2" to 4", such as any value from 2" to 4". A dimension d4 of about 3", 3.25" or 3.5" is effective in at least one embodiment. The dimension d5 may be in a range of from 2" to 4", such as any value from 2" to 4". A dimension d5 of about 3", 3.25 or 3.5" is effective in at least one embodiment.

As shown in FIG. 5, the boot jack 10 may have a maximum width d6, as seen in plan view, at a distal end of the boot grip portion 106, that is, at an end of the boot grip portion 106 opposite the end attached to the intermediate portion 104. The boot jack 10 may have a minimum width d7, as seen in plan view, at a distal end of the base 102, that is, at an end of the base 102 opposite the end attached to the intermediate portion 104. Thus, the boot jack 10 may have an overall tapered shape in plan view, as shown in FIG. 5. The maximum width d6 may be a range of from 3" to 6", such as any value from 3" to 6". A maximum width d6 of about 4.5", 4.6", 4.7" 4.8", 4.9", 5", 5.1", 5.2" or 5.3" is effective in at least one embodiment. The minimum width d7 may be a range of from 1.5" to 5", such as any value from 1.5" to 5". A minimum width d7 of about 2.7", 2.8", 2.9", 3", 3.1", 3.2", 3.3" or 3.4" is effective in at least one embodiment. The boot jack 10 may have an overall length d8 in a range of from 6" to 12", such as any value from 6" to 12". An overall length d8 of about 9", 9.5", 10", 10.5", 11" or 11.5" is effective in at least one embodiment.

Figure 7:
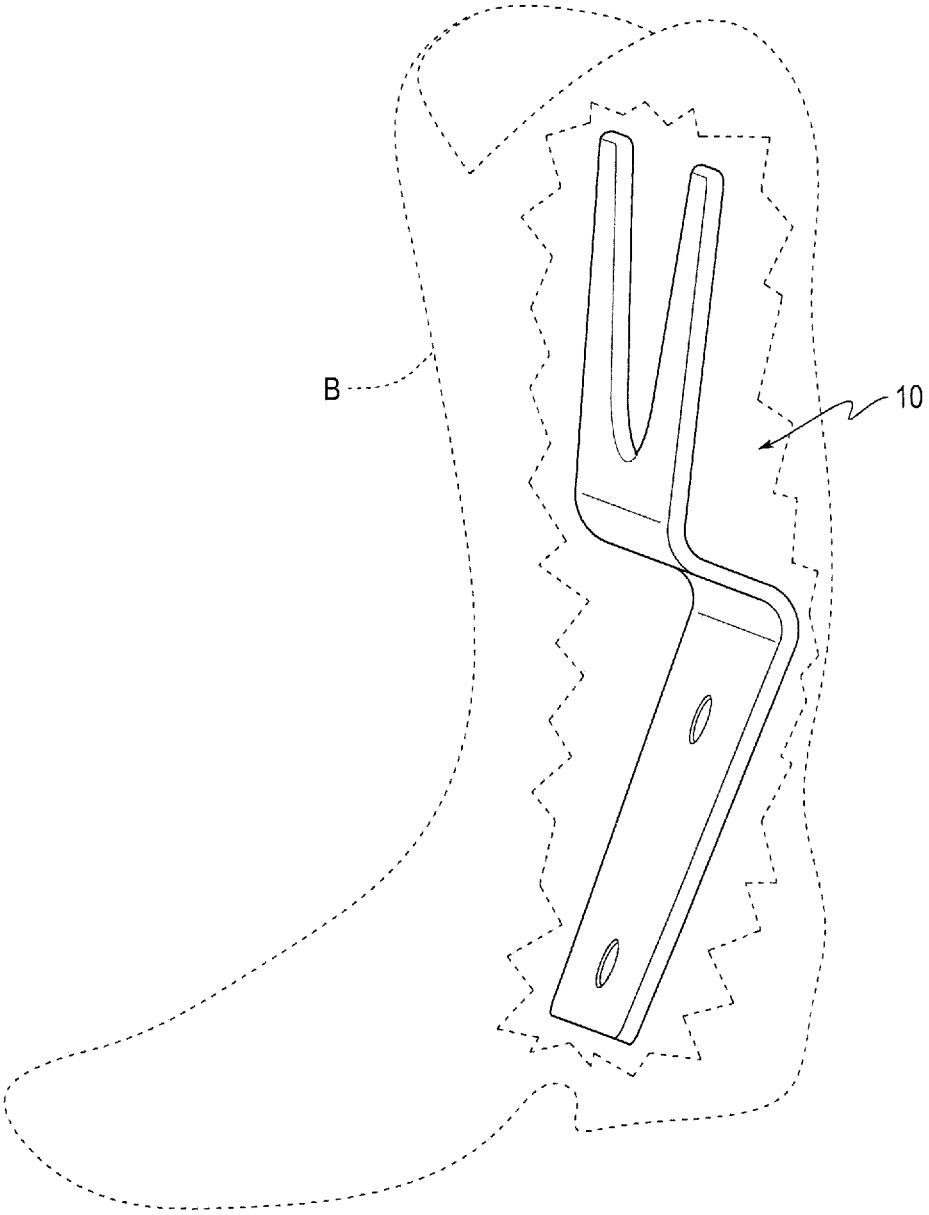
FIG. 7 is a perspective cut-away view of the boot jack of FIG. 1, inserted into a boot for storage.

With such overall dimensions, the boot jack 10 can fit inside a boot B, as shown in FIG. 7, and thus can be conveniently stowed when packing a pair of boots for travel, for example, or at other times when the boots are not being worn. For example, the overall tapered shape has the minimum width at the distal end of the base 102 to allow easy fitting into the boot, and the maximum width at the distal end of the boot grip portion 106 to allow ample space for the boot grip contour 1064.

The boot grip portion 106 and the base 102 may be sized and shaped such that the base 102 lies flat on the floor under its own weight, when placed on the floor.

In use, the boot jack 10 is placed on the floor with the base 102 parallel to the floor. A person wearing a boot may place one foot on the base 102, place the other foot, wearing the boot to be removed, such that the heel of the boot fits against and is held by the boot grip contour 1064, and pull that foot out of the boot, while the boot is held by the boot grip contour 1064. For storage, the boot jack 10 may be inserted into the boot, with the narrower end of the boot jack (i.e., the end having the dimension d7 described above) being inserted first into the boot.

An advantage of the depicted embodiment, compared with some other boot jacks, is that the "holding" foot, i.e., the foot that is placed on the base 102, can remain generally parallel to the floor and close to the floor while the boot is being removed from the other foot. In this context, "holding foot being generally parallel" means that the front part of the holding foot, or of a boot or other footwear that the holding foot is wearing, is raised from the floor no more than the thickness of the base portion, while the heel of the holding foot, or of a boot or other footwear that the holding foot is wearing, is in contact with the floor (or is also raised. from the floor no more than the thickness of the base portion, if the base portion is long enough to be contacted by the heel). This can help the person removing the boot be more stable and comfortable while removing the boot.

The boot jack 10 can be made very light in weight, and in addition to being able to fit into a boot, can also easily fit into a suitcase or other luggage item. Specifically, when the boot jack 10 is structured as depicted in the drawings, it can easily fit between clothing or other items in the suitcase or other luggage item.

While the invention has been described in conjunction with the specific embodiments described above, these embodiments should be viewed as illustrative and not limiting. Various changes, substitutes, improvements or the like are possible within the spirit and scope of the invention.

What is claimed is:

1. A boot jack, comprising:

a base;

an intermediate portion extending from the base in a direction crossing a plane of the base, the intermediate portion having a first end and a second end; and a boot grip portion extending from the second end of intermediate portion in a direction crossing a plane of the intermediate portion, wherein the boot jack has an overall tapered shape as seen in plan view, the plan view being perpendicular to a plane of the base, the boot lack having a minimum width, as seen in the plan view, at an end of the base opposite the intermediate portion, each portion of the base being narrower than the intermediate portion, as seen in the plan view, wherein the base, the intermediate portion, and the boot grip portion have the same thickness, and wherein a transition between the boot grip portion and the intermediate portion is rounded, and a transition between the base and the intermediate portion is rounded.

2. The boot jack according to claim 1, wherein the boot grip portion extends at an angle relative to a line parallel to the base, as seen in a side view, the angle being in a range of from 10° to 20°.

3. The boot jack according to claim 1, an overall length of the boot jack being in a range of from 9" to 11.5".

4. The boot jack according to claim 1, wherein the base continuously narrows from the intermediate portion to the end of the base opposite the intermediate portion.

5. A method of storing a boot jack that comprises (i) a base; (ii) an intermediate portion extending from the base in a direction crossing a plane of the base, the intermediate portion having a first end and a second end; and (iii) a boot grip portion extending from the second end of intermediate portion in a direction crossing a plane of the intermediate portion, wherein the boot jack has an overall tapered shape as seen in plan view, the plan view being perpendicular to a plane of the base, the boot jack having a minimum width, as seen in the plan view, at an end of the base opposite the intermediate portion, each portion of the base being narrower than the intermediate portion, as seen in the plan view, the method comprising:

inserting the boot jack into a boot, wherein the end of the base opposite the intermediate portion is inserted first into the boot.

6. A method of using a boot jack that comprises (i) a base; (ii) an intermediate portion extending from the base in a direction crossing a plane of the base, the intermediate portion having a first end and a second end; and (iii) a boot grip portion extending from the second end of intermediate portion in a direction crossing a plane of the intermediate portion, wherein the boot jack has an overall tapered shape as seen in plan view, the plan view being perpendicular to a plane of the base, the boot jack having a minimum width, as seen in the plan view, at an end of the base opposite the intermediate portion, each portion of the base being narrower than the intermediate portion, as seen in the plan view, the method comprising:

placing one foot on the base of the boot jack, the one foot being generally parallel to a surface on which the boot jack is placed, placing another foot, wearing a boot to be removed, such that a heel of the boot fits against and is held by the boot grip portion, and pulling the other foot out of the boot, while the boot is held by the boot grip portion.

* * * * *